US008936431B2

(12) United States Patent
Chouhan et al.

(10) Patent No.: US 8,936,431 B2
(45) Date of Patent: Jan. 20, 2015

(54) SHROUD FOR A ROTARY MACHINE AND METHODS OF ASSEMBLING SAME

(75) Inventors: Rohit Chouhan, Bangalore (IN); Sumeet Soni, Bangalore (IN)

(73) Assignee: General Electric Company, Schenectady, NY (US)

( * ) Notice: Subject to any disclaimer, the term of this patent is extended or adjusted under 35 U.S.C. 154(b) by 386 days.

(21) Appl. No.: 13/492,203

(22) Filed: Jun. 8, 2012

(65) Prior Publication Data

US 2013/0330179 A1 Dec. 12, 2013

(51) Int. Cl.
*F01D 11/12* (2006.01)

(52) U.S. Cl.
USPC ..... 415/168.4; 415/173.4; 415/173.5; 415/173.6; 415/209.2; 415/210.1; 415/914; 277/414; 277/415; 277/419; 29/889.2; 29/889.22

(58) Field of Classification Search
USPC ..... 415/168.2, 168.4, 173.1, 173.4–173.6, 415/914, 1, 189–190, 209.2–209.4, 210.1, 415/173.7; 277/414, 415, 418, 419; 29/889.2, 889.22
See application file for complete search history.

(56) References Cited

U.S. PATENT DOCUMENTS

| | | | | |
|---|---|---|---|---|
| 3,867,060 | A * | 2/1975 | Huber | 415/173.5 |
| 5,029,876 | A * | 7/1991 | Orlando et al. | 277/419 |
| 5,224,713 | A | 7/1993 | Pope | |
| 6,059,525 | A * | 5/2000 | Jiomacas et al. | 415/173.1 |
| 6,131,910 | A | 10/2000 | Bagepalli et al. | |
| 6,439,844 | B1 | 8/2002 | Turnquist et al. | |
| 6,652,226 | B2 | 11/2003 | Albrecht, Jr. et al. | |
| 6,761,530 | B1 | 7/2004 | Ginessin et al. | |
| 6,896,482 | B2 | 5/2005 | Parry | |
| 7,059,821 | B2 | 6/2006 | Farrell et al. | |
| 7,645,117 | B2 | 1/2010 | Bracken et al. | |
| 7,665,964 | B2 | 2/2010 | Taylor et al. | |
| 2005/0232764 | A1 * | 10/2005 | Chiu et al. | 415/214.1 |
| 2008/0075600 | A1 * | 3/2008 | Moors et al. | 416/189 |
| 2009/0206554 | A1 | 8/2009 | Bowen et al. | |
| 2013/0170962 | A1 * | 7/2013 | Chouhan | 415/173.1 |
| 2013/0236298 | A1 * | 9/2013 | Chouhan | 415/173.5 |

* cited by examiner

*Primary Examiner* — Christopher Verdier
(74) *Attorney, Agent, or Firm* — Armstrong Teasdale LLP

(57) ABSTRACT

A shroud for a turbine and a method of assembling is provided. The turbine includes a housing, a rotatable shaft and a bucket extending outward therefrom. The shroud includes an alignment member which is coupled to the housing, wherein the alignment member includes a first end, a second end and a body extending between the first and second ends. The second end includes an arcuate portion to facilitate fluid flow downstream from the bucket. The shroud further includes a seal coupled to the body to facilitate sealing a gap defined between the bucket and the body.

14 Claims, 8 Drawing Sheets

SHROUD FOR A ROTARY MACHINE AND METHODS OF ASSEMBLING SAME

BACKGROUND

The present invention relates generally to rotary machines, and more particularly, to methods and apparatus to facilitate fluid flow within the rotary machine by reducing fluid leakage losses and fluid mixing losses within the rotary machine.

Rotary machines, such as gas turbines, are used to generate power for electric generators. A gas turbine has a gas path which typically includes, in serial-flow relationship, an air intake (or inlet), a compressor, a combustor, a turbine, and a gas outlet (or exhaust nozzle). Compressor and turbine sections include at least one row of circumferentially spaced rotating buckets or blades positioned within a housing.

Turbine efficiency depends at least in part on a radial clearance or gap between tips of the rotating buckets and a shroud coupled to the surrounding housing. The clearance is needed to avoid contact or rubbing between the bucket tips and the shroud which results in a design limitation for the size of the clearance. If the clearance is too large, enhanced gas flow may leak through the clearance gaps, thus decreasing the turbine's efficiency. Leakage flow, either out of the flow path or into the flow path, from an area of higher pressure to an area of lower pressure, is generally undesirable. If the clearance is too small, the rotor bucket tips may undesirably contact/rub the surrounding shroud during certain turbine operating conditions, which may also decrease the turbine's efficiency. To accommodate for the design limitation of the clearance gap, some known turbines utilize honeycomb and/or labyrinth seals with the shroud and/or bucket to reduce leakage flow through the clearance gap.

FIG. 1 is a cross-sectional view of a known shroud 10 having a seal 12 that can be used with a known gas turbine 14. Known turbines 14 include seals 12, such as honeycomb and/or labyrinth seals, to reduce flow through a gap 16. More particularly, known labyrinth seals 12 include a tortuous path defined by longitudinally spaced-apart rows of labyrinth seal teeth 18 that seal against high-pressure differentials that may be present in the turbine 14. However, the configurations of some known labyrinth seals 12 may induce fluid mixing losses and/or flow leakage losses of the gas on an exit side 20 of rotating buckets 22 that may adversely affect the efficiency of the turbine 14. More particularly, flow paths of leakage flow 24 for some known seals 12 are sometimes not aligned with a subsequent nozzle 26, wherein misalignment increases the re-circulation of leakage flow 24 within the bucket exit side 20 subsequent labyrinth seal 12. The re-circulation of leakage flow 24 may mix with main flow 28, which may also adversely affect turbine efficiency.

BRIEF DESCRIPTION

In one aspect, a shroud for a turbine is provided. The turbine includes a housing, a rotatable shaft, and a bucket extending outward therefrom. The shroud includes an alignment member which is coupled to the housing, wherein the alignment member includes a first end, a second end, and a body extending between the first and second ends. The second end includes an arcuate portion configured to facilitate fluid flow downstream from the bucket. The shroud further includes a seal coupled to the body to facilitate sealing a gap defined between the bucket and the body.

In another aspect, a turbine is provided. The turbine includes a housing, a turbine shaft rotatably supported in the housing, and a plurality of turbine stages located along the turbine shaft and contained within the housing. Each turbine stage includes a rotor coupled to the turbine shaft, wherein the rotor includes a bucket radially extending outward therefrom. A shroud is coupled to the housing and includes a first end, a second end, and a body extending between the first and second ends. The second end includes an arcuate portion configured to facilitate leakage flow downstream from the bucket. The body further includes a first groove and a second groove. A seal is coupled to the first groove and the second groove to facilitate sealing a gap defined between the bucket and the body.

In a further aspect, a method of assembling a shroud to a turbine is provided. The turbine has a housing, a rotatable shaft and a bucket radially extending outward from the rotatable shaft. The method includes coupling a shroud to the housing and extending an arcuate portion of the shroud outward from the housing to facilitate fluid flow downstream from the bucket. The method further includes coupling a seal to the shroud to facilitate sealing a gap defined between the bucket and the shroud.

DETAILED DESCRIPTION

Figure 2:
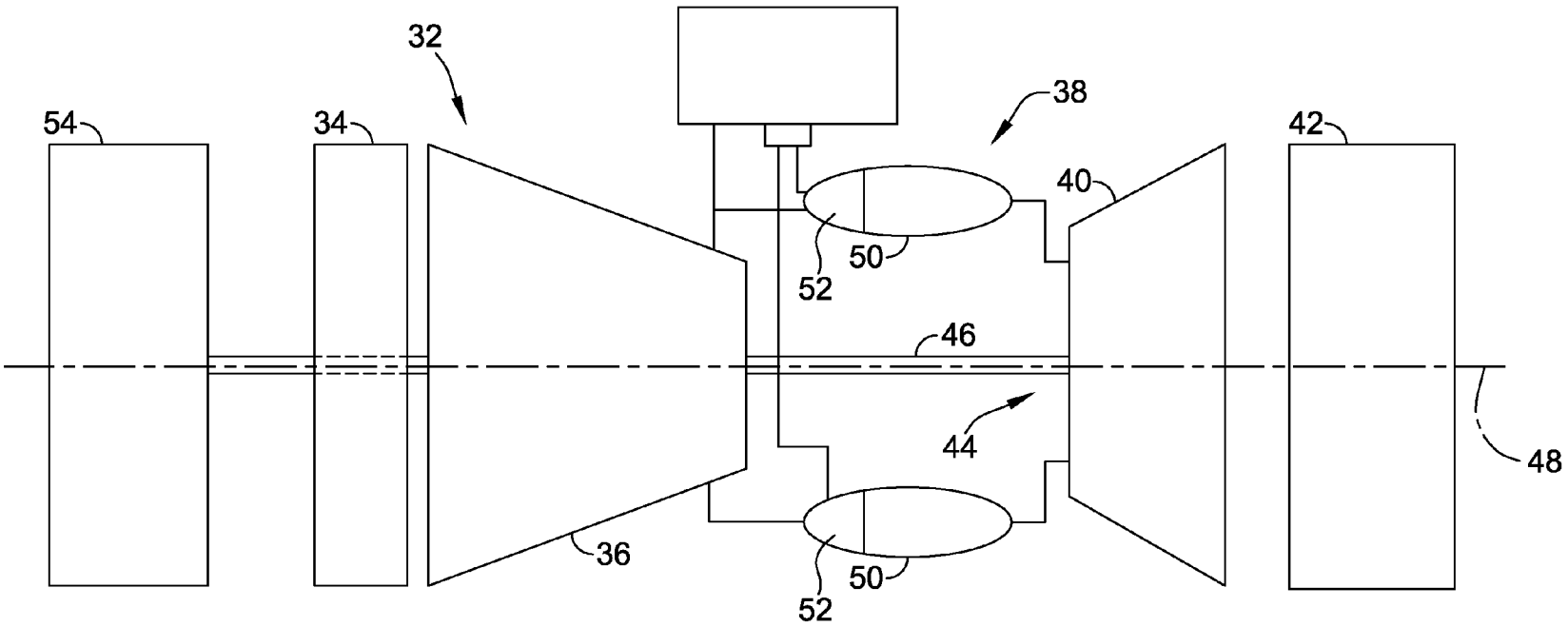
FIG. 2 is a schematic view of a rotary machine.

FIG. 2 is a schematic view of a rotary machine 30, such as a gas turbine 32. Turbine 32 includes an intake section 34, a compressor section 36 that is downstream from intake section 34, a combustor section 38 downstream from compressor section 36, a turbine section 40 downstream from combustor section 38, and an exhaust section 42 downstream from turbine section 40. Turbine section 40 is coupled to compressor section 36 via a rotor assembly 44 that includes a shaft 46 that extends along a centerline axis 48. Combustor section 38 includes a plurality of combustor assemblies 50 that are each coupled in flow communication with the compressor section 36. A fuel nozzle assembly 52 is coupled to each combustor assembly 50. Turbine section 40 is rotatably coupled to compressor section 36 and to a load 54 such as, but not limited to, an electrical generator and/or a mechanical drive application.

During operation, air flows through compressor section 36 and compressed air is discharged into combustor section 38. Combustor assembly 50 injects fuel, for example, natural gas and/or fuel oil, into the air flow, ignites the fuel-air mixture to expand the fuel-air mixture through combustion, and generates high temperature combustion gases. Combustion gases are discharged from combustor assembly 50 towards turbine section 40, wherein thermal energy in the gases is converted to mechanical rotational energy. Combustion gases impart rotational energy to turbine section 40 and to rotor assembly 44, which subsequently provides rotational power to compressor section 36.

Figure 3:
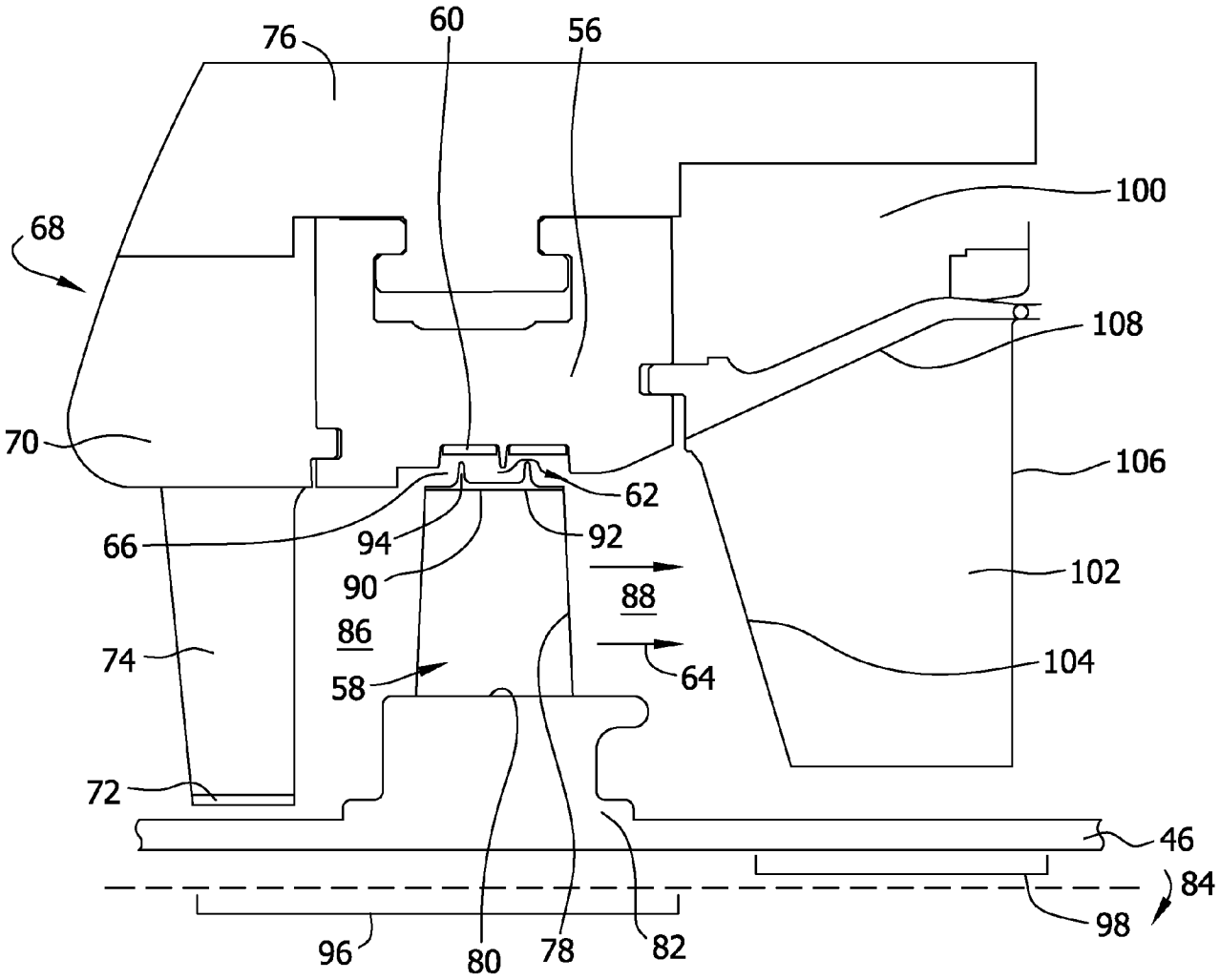
FIG. 3 is a cross-sectional view of an exemplary diaphragm, a shroud, a rotor, and a seal that may be used with the rotary machine shown in FIG. 2.

FIG. 3 is a cross-sectional view of an exemplary shroud 56, rotor 58, and seal 60 used with turbine 32 (shown in FIG. 2). Shroud 56 is configured to mitigate leakage flow 62 such as, but not limited to, hot gas flow within turbine 32 and to mitigate leakage flow 62 mixing with main flow 64, for example, hot gas flow through turbine 32. A clearance gap 66 is defined between shroud 56 and tip of rotor 58, wherein seal 60 is configured to facilitate sealing gap 66 to reduce leakage flow 62 through gap 66. In the exemplary embodiment, turbine 32 includes a diaphragm 68 having a radial outer portion 70, a radial inner portion 72, and a nozzle 74. Shroud 56 and radial outer portion 70 are coupled to a housing 76, while nozzle 74 is coupled to radial outer portion 70, and radial inner portion 72 is coupled to nozzle 74.

Rotor 58 includes turbine buckets 78 that are coupled at their radially inner ends 80 to turbine wheels 82 extending radially outward from turbine shaft 46 such that buckets 78 are rotatable about an axis 84. Bucket 78 has a flow inlet side 86 and a flow outlet side 88, which is downstream of flow inlet side 86. Bucket 78 further includes a bucket tip 92, wherein bucket tip 92 includes a plurality of teeth 94 extending radially therefrom, within gap 66 and towards shroud 56. A set of stationary nozzles 74 and rotating buckets 78 form a stage 96 of turbine 32. Moreover, turbine 32 includes a subsequent stage 98 having a subsequent radial outer portion 100 and a nozzle 102. Nozzle 102 includes an inlet side 104, an outlet side 106, and side wall 108. Side wall 108 is angled with respect to shroud 56.

Figure 4:
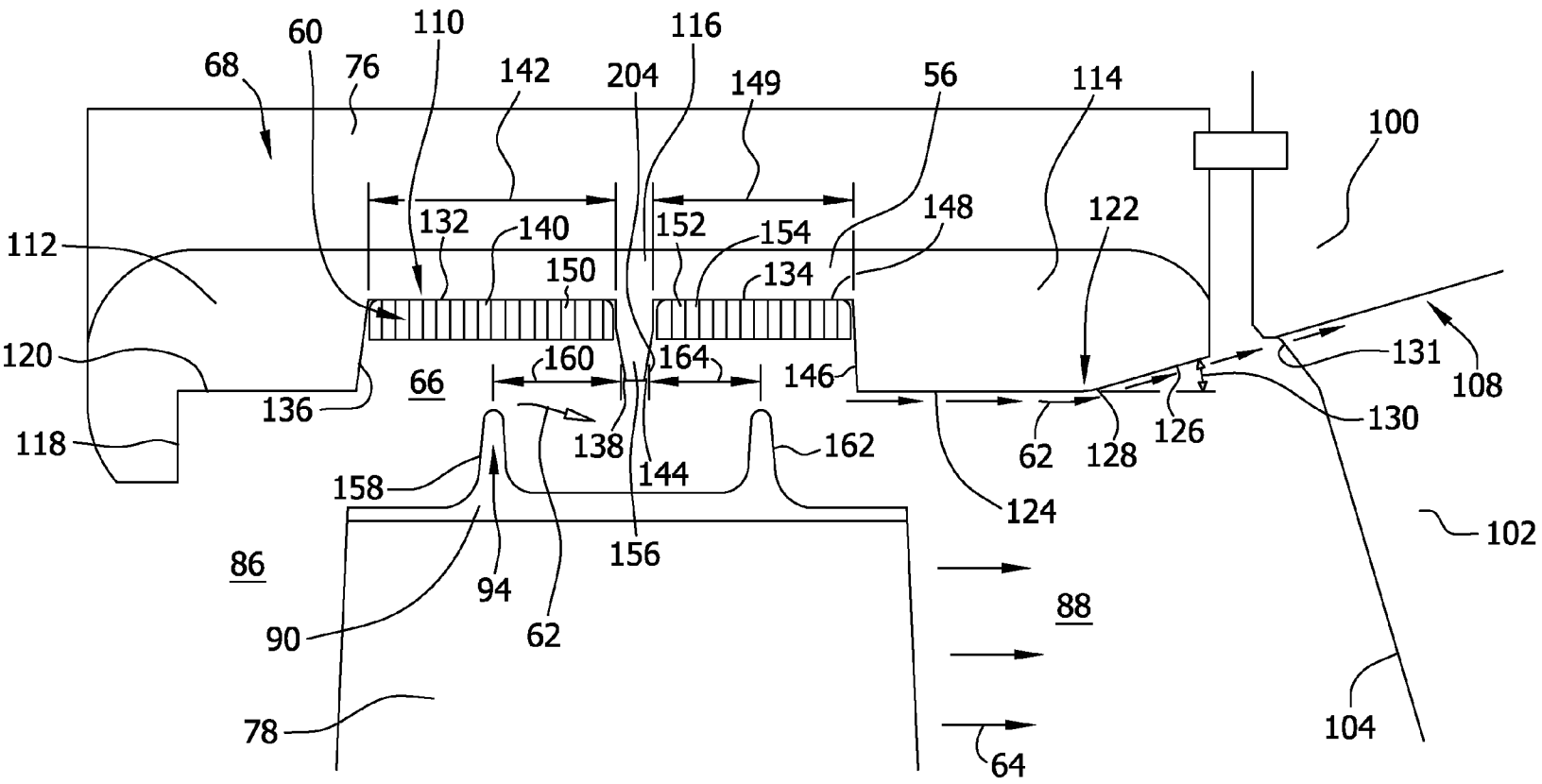
FIG. 4 is a cross-sectional view of the exemplary shroud that may be used with the diaphragm shown in FIG. 3.

FIG. 4 illustrates a cross-sectional view of shroud 56. Shroud 56 includes an alignment member 110 having a first end 112, a second end 114, and a body 116 extending between first end 112 and second end 114. Shroud 56 is sized and shaped to maintain gap 66 as minimally allowed between bucket teeth 94 and seal 60 to provide a tortuous path for leakage flow 62 from bucket inlet side 86 through gap 66 and into bucket outlet side 88. First end 112 includes a first substantially straight portion 118 and a second substantially straight portion 120. In the exemplary embodiment, portions 118 and 120 are positioned substantially orthogonal to each other. Alternatively, any orientation of portions 118 and 120 may be used that enables turbine 32 to function as described herein.

Figure 1:
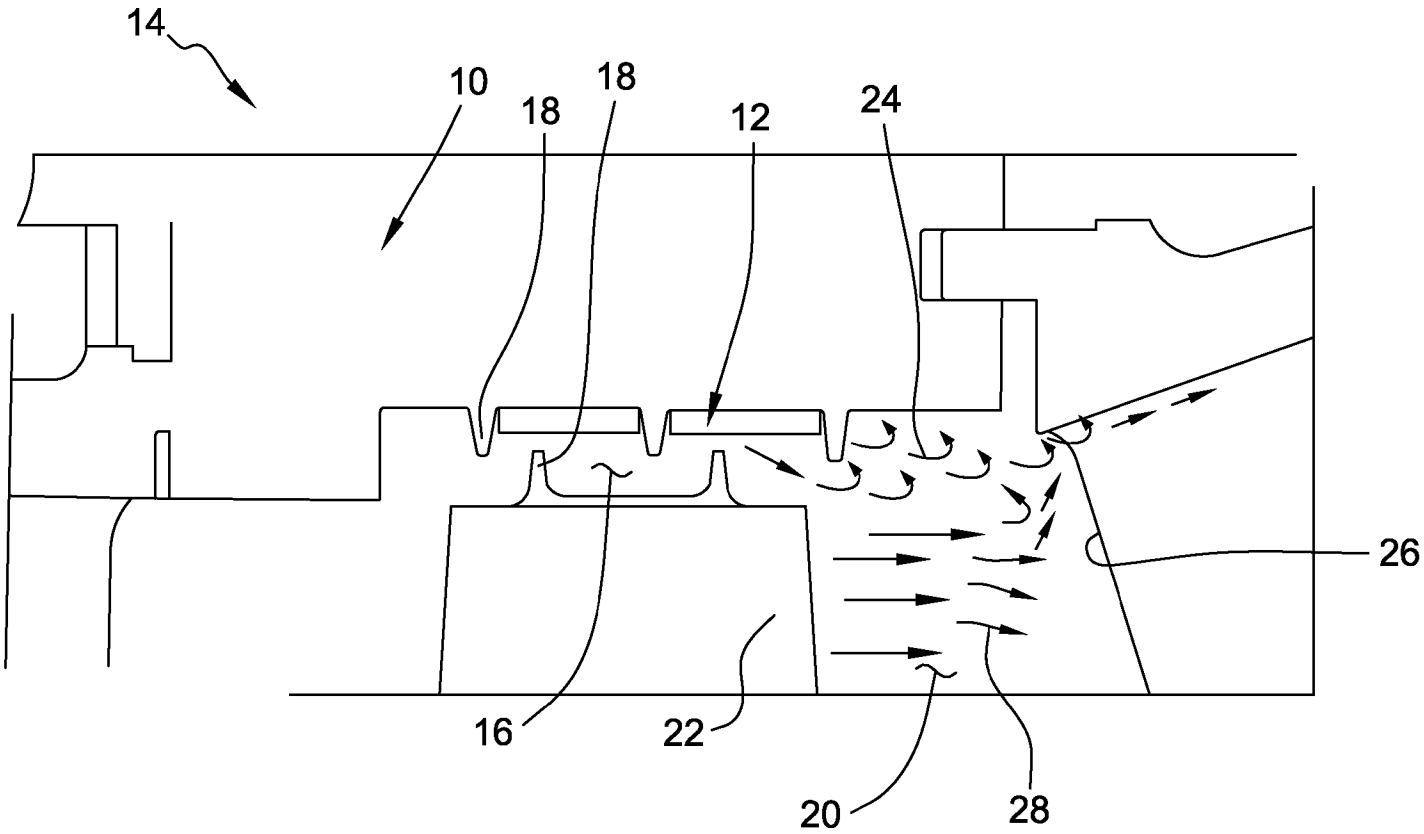
FIG. 1 PRIOR ART
FIG. 1 is a cross-sectional view of a known shroud used with a known gas turbine.

Second end 114 is configured to channel tip leakage flow 62 from gap 66, downstream from bucket 78, and towards nozzle side wall 108. In the exemplary embodiment, second end 114 is sized and shaped to substantially match a flow profile of side wall 108 of nozzle 102 to facilitate alignment of leakage flow 62 towards sidewall 108 to minimize and/or eliminate re-circulation of leakage flow 62 into bucket outlet side 88 as compared to conventional turbines 14 (shown in FIG. 1). Second end 114 includes a substantially smooth profile 122 which is configured to direct leakage flow 62 toward side wall 108 to facilitate minimizing and/or eliminating sharp turns of leakage flow 62. Moreover, second end 114 is configured to facilitate minimizing and/or eliminating mixing of leakage flow 62 with main flow 64. In the exemplary embodiment, second end 114 includes a first substantially straight portion 124, a second substantially straight portion 126, and an arcuate portion 128 extending between portions 124 and 126. At least one of the arcuate portion and the pair of substantially straight portions are in flow alignment with the nozzle wall of the subsequent stage of the plurality of stages to facilitate alignment of leakage flow toward the nozzle wall. Alternatively, second end 114 may include any number of straight and arcuate portions to enable shroud 56 to function as described herein.

In the exemplary embodiment, arcuate portion 128 extends radially outward from housing 76. As illustrated, because arcuate portion 128 extends radially outward from housing 76, second substantially straight portion 126 is positioned at an angle 130 relative to first substantially straight portion 124 and in line to side wall 108 of subsequent nozzle 102. Moreover, in the exemplary embodiment, second substantially straight portion 126 is orientated at less than about 45° relative to first substantially straight portion 124. The orientation of first substantially straight portion 124, second substantially straight portion 126, and arcuate portion 128 facilitates leakage flow 62 downstream beyond bucket 78 and towards nozzle sidewall 108. More particularly, arcuate portion 128 is configured to position second portion 126 in substantial alignment with angle of sidewall 108 to facilitate leakage flow 62 from gap 66, downstream of bucket 78 and toward nozzle 102. Any orientation of first and second portions 124 and 126 and arcuate portion 128 may be used to facilitate flow alignment with nozzle side wall 108, and enables turbine 32 to function as described herein. Moreover, because arcuate portion 128 is configured to direct leakage flow 62 toward side wall 108, arcuate portion 128 facilitates minimizing and/or eliminating re-circulation and mixing of leakage flow 62 with main flow 64.

Arcuate portion 128 is sized and shaped to facilitate reducing and/or eliminating flow mixing losses and/or flow path losses through gap 66 as compared to conventional shrouds having substantially straight exit ends, which increases efficiencies of turbine operations. More particularly, arcuate portion 128 is configured to channel leakage flow 62 substantially uniform out of gap 66 and towards nozzle 102, and to facilitate smooth transition of leakage flow 62 in alignment with nozzle wall 108 towards nozzle 102. Moreover, the shape of arcuate portion 128 directs leakage flow 62 to minimize flow impact of leakage flow 62 toward side wall 108 against a nozzle arcuate surface 131. Reducing flow impact of leakage flow 62 facilitates reducing and/or eliminating oxidation of nozzle arcuate surface 131 and/or adverse heat effects on surface 131, to enhance increasing operating life of nozzle 102.

In the exemplary embodiment, alignment member 110 also includes a first groove 132 and a second groove 134. First groove 132 and second groove 134 are in flow communication with gap 66 and facilitate coupling seal 60 to body 116. First groove 132 is defined by opposing side walls 136 and 138 and an end wall 140 that extends between side walls 136 and 138. End wall 140 has a first length 142. In the exemplary embodiment, side walls 136 and 138 are angled towards body 116 to facilitate reducing flow leakage and flow losses across gap 66. Alternatively, side walls 136 and 138 may extend orthogonally (not shown) to body 116.

Second groove 134 is defined by opposing side walls 144 and 146 and an end wall 148 that extends between side walls 144 and 146. End wall 148 has a second length 149. End wall length 142 is longer than end wall length 149. A shortened second groove 134 facilitates channeling leakage flow 62 out of gap 66 to facilitate reducing flow leakages and losses of fluid flow 62 downstream towards each subsequent nozzle 102 and subsequent bucket (not shown). Alternatively, lengths 142 and 149 can have any length that enables seal 60 to function as described herein. In the exemplary embodiment, sidewalls 144 and 146 are angled towards body 116 to facilitate reducing flow leakages and losses across gap 66. Alternatively, side walls 144 and 146 may extend orthogonally (not shown) to body 116.

Seal 60 extends between bucket 78 and member 110. In the exemplary embodiment, seal 60 includes a honeycomb seal 150 that is coupled to body 116 and that is mounted within at least first groove 132 and second groove 134. Honeycomb seal 150 is fabricated from thin corrugated strips 152 that are mated together in a honeycomb configuration to form cells 154. In the exemplary embodiment, cells 154 are each hexagonal. Alternatively, cells 154 can have any other shape, including circular, triangular, and/or rectangular, that enables seal 60 to function as described herein. Additionally, or alternatively, seal 60 can include other seals such as, but not limited to, brush seals (not shown).

Seal 60 also includes at least one seal tooth 156 that extends from body 116 into gap 66. Tooth 156 defines a tortuous path with teeth 94 that facilitates mitigating leakage flow 62 through gap 66. In the exemplary embodiment, seal tooth 156 is positioned between grooves 132 and 134. A first tooth 158 of teeth 94 is spaced a first distance 160 from seal tooth 156 and a second tooth 162 of teeth 94 is spaced at a second distance 164 from seal tooth 156. In the exemplary embodiment, first distance 160 is longer than second distance 164. A shortened second distance 164 facilitates reducing flow leakages and flow losses of leakage flow 62 towards arcuate portion 128. Alternatively, distances 160 and 164 can have any length that enables seal 60 to function as described herein. In the exemplary embodiment, first end 112 and second end 114 of alignment member 110 minimize and/or eliminate additional seal teeth on opposite sides of tooth 156. Moreover, seal tooth 156 is thicker than conventional teeth 18 (shown in FIG. 1) to better withstand oxidation effects as compared to conventional teeth 18 to reduce maintenance and replacement costs for turbine 32. Alternatively, alignment member 110 may include multiple teeth 156 to enable shroud 56 to function as described herein.

Figure 5:
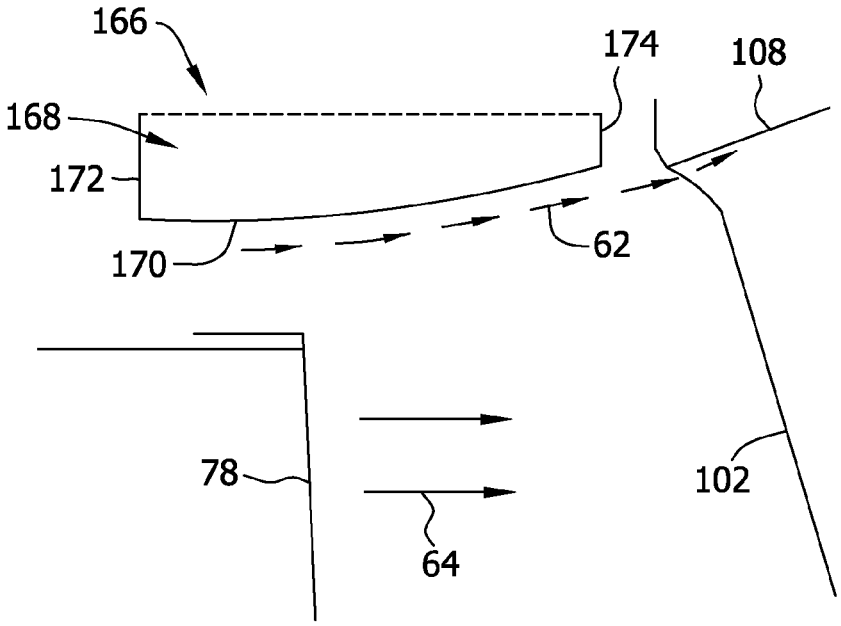
FIG. 5 is a cross-sectional view of another exemplary shroud that may be used with the diaphragm shown in FIG. 3.

FIG. 5 is a side view of another exemplary end 168 of shroud 166 that may be used with diaphragm 68 shown in FIG. 4. Unless otherwise specified, similar components are labeled in FIG. 5 with the same reference numerals used in FIGS. 3 and 4. End 168 includes an arcuate portion 170 extending between an end 172 and an end 174. Arcuate portion 170 is sized and shaped to direct leakage flow 62 downstream of bucket 78 and towards nozzle sidewall 108. More particularly, arcuate portion 170 is configured to facilitate minimizing and/or eliminating re-circulation of leakage flow 62 into bucket outlet side 88, which minimizes and/or eliminates mixing of leakage flow 62 with main flow 64. Moreover, end 168 is sized and shaped to reduce leakage losses of leakage flow 62 within gap 66 (shown in FIG. 4).

Figure 6:
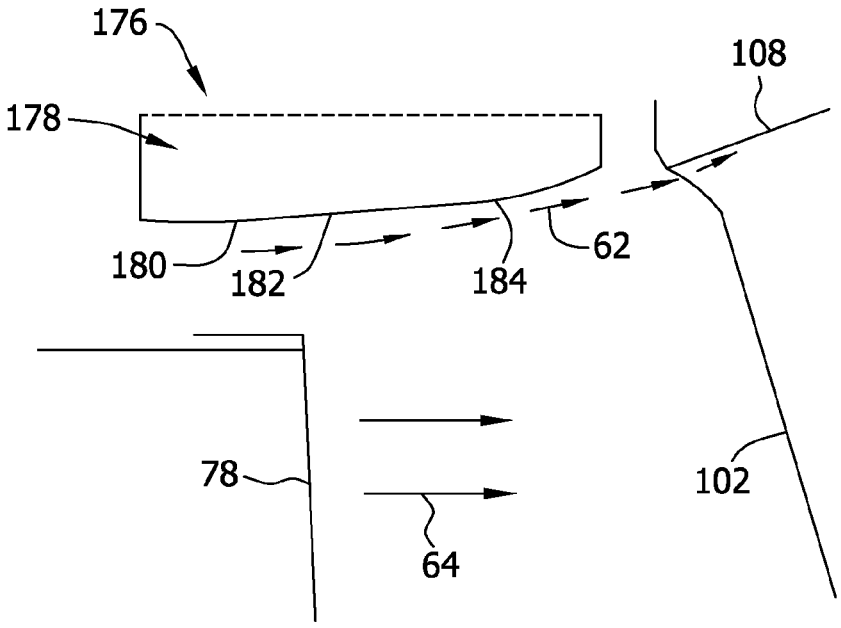
FIG. 6 is a cross-sectional view of another exemplary shroud that may be used with the diaphragm shown in FIG. 3.

FIG. 6 is a side view of another exemplary end 178 of shroud 176 that may be used with the diaphragm 68 shown in FIG. 4. Unless otherwise specified, similar components are labeled in FIG. 6 with the same reference numerals used in FIGS. 3 and 4. End 178 includes an arcuate portion 180, a straight portion 182, and an arcuate portion 184. Portions 180, 182, and 184 are sized and shaped to direct leakage flow 62 downstream from bucket 78 and towards nozzle sidewall 108. More particularly, end 178 is configured to facilitate minimizing and/or eliminating re-circulation of leakage flow 62 into bucket outlet side 88, which minimizes and/or eliminates mixing of leakage flow 62 with main flow 64. Moreover, portions 180, 182, and 184 are sized and shaped to reduce leakage losses of leakage flow 62 within gap 66 (shown in FIG. 4).

Figure 7:
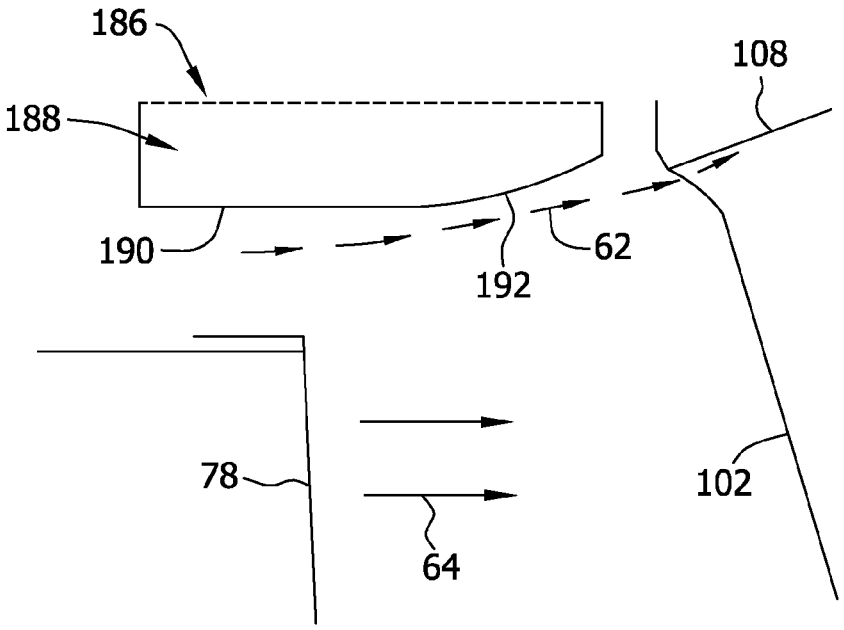
FIG. 7 is a cross-sectional view of another exemplary shroud that may be used with the diaphragm shown in FIG. 3.

FIG. 7 is a side view of another exemplary end 188 of shroud 186 that may be used with the diaphragm 68 shown in FIG. 4. Unless otherwise specified, similar components are labeled in FIG. 7 with the same reference numerals used in FIGS. 3 and 4. End 188 includes a straight portion 190 and an arcuate portion 192. Portions 190 and 192 are sized and shaped to direct leakage flow 62 downstream from bucket 78 and towards nozzle side wall 108. More particularly, end 188 is configured to facilitate minimizing and/or eliminating re-circulation of leakage flow 62 into bucket outlet side 88, which minimizes and/or eliminates mixing of leakage flow 62 with main flow 64. Moreover, portions 190 and 192 are sized and shaped to reduce leakage losses of leakage flow 62 within gap 66 (shown in FIG. 4).

Figure 8:
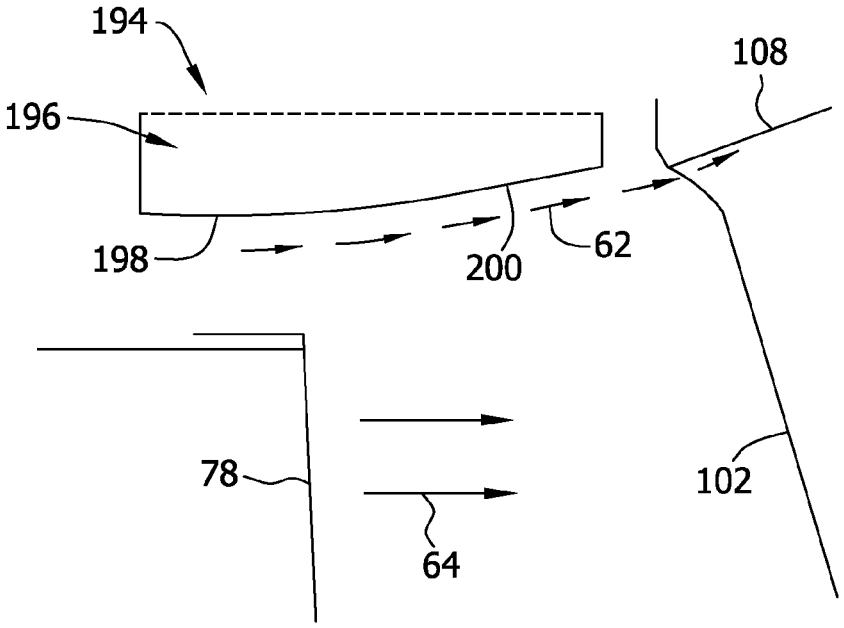
FIG. 8 is a cross-sectional view of another exemplary shroud that may be used with the diaphragm shown in FIG. 3.

FIG. 8 is a side view of another exemplary end 196 of shroud 194 that may be used with the diaphragm 68 shown in FIG. 4. Unless otherwise specified, similar components are labeled in FIG. 8 with the same reference numerals used in FIGS. 3 and 4. End 196 includes an arcuate portion 198 and a straight portion 200. Portions 198 and 200 are sized and shaped to direct leakage flow 62 downstream from bucket 78 and towards nozzle sidewall 108. More particularly, end 196 is configured to facilitate minimizing and/or eliminating re-circulation of leakage flow 62 into bucket outlet side 88, which minimizes and/or eliminates mixing of leakage flow 62 with main flow 64. Moreover, portions 198 and 200 are sized and shaped to reduce leakage losses of leakage flow 62 within gap 66 (shown in FIG. 4).

Figure 9:
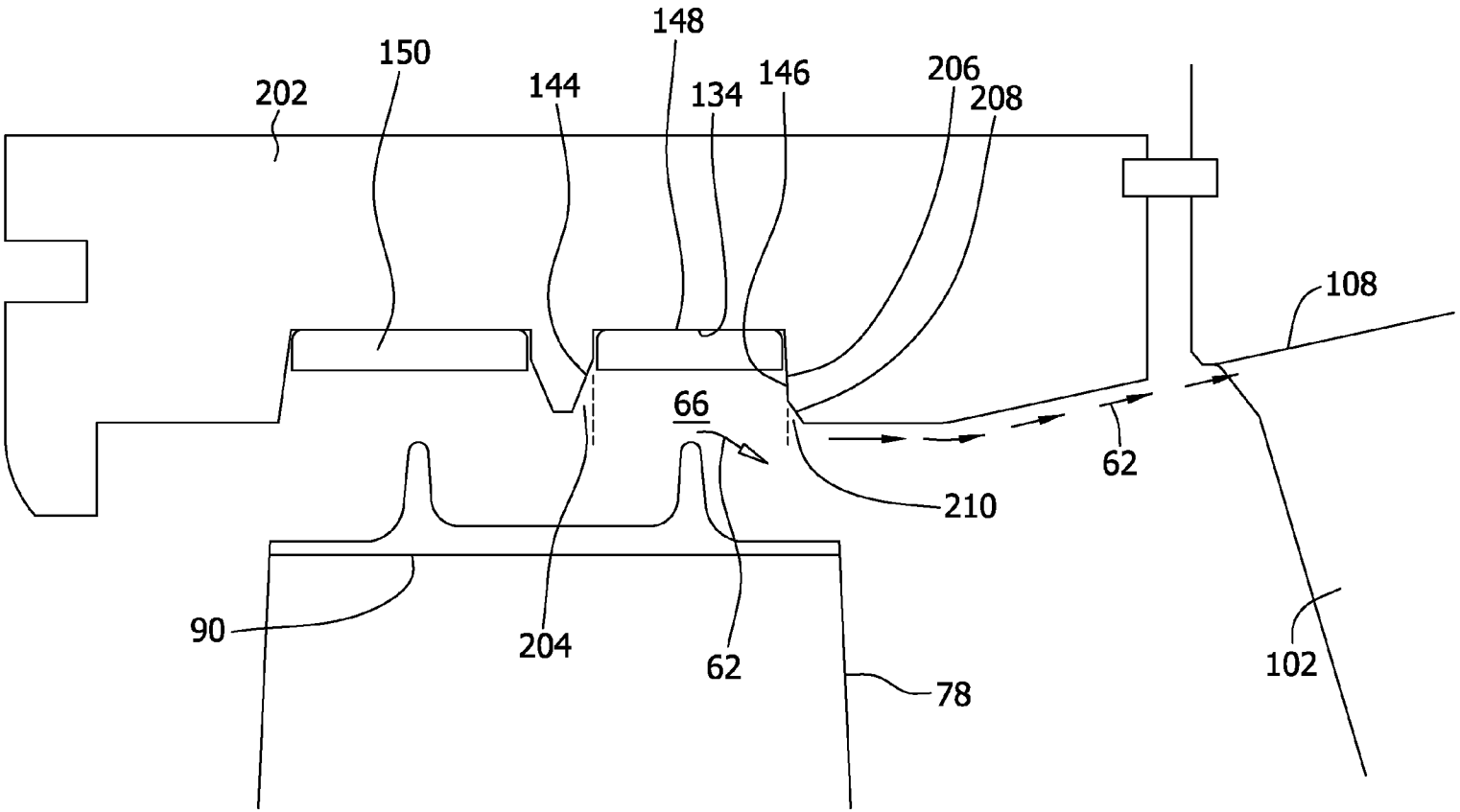
FIG. 9 is a cross-sectional view of another exemplary shroud that may be used with the shroud shown in FIG. 3.

FIG. 9 is a cross-sectional view of another exemplary shroud 202 that may be used with diaphragm 68 (shown in FIG. 4). Unless otherwise specified, similar components are labeled in FIG. 9 with the same reference numerals used in FIGS. 3 and 4. In the exemplary embodiment, second groove 134 is defined by opposing side walls 144 and 146, and end wall 148. More particularly, side wall 144 is oriented at a first angle 204 relative to end wall 148. Opposite side wall 146 includes a substantially straight portion 206 and an angled portion 208 that is oriented at a second angle 210 relative to end wall 148. In the exemplary embodiment, first angle 204 is larger than second angle 210. Straight portion 206, angled portion 208 and angles 204 and 210 are sized, shaped, and orientated to facilitate reducing and/or eliminating reducing flow mixing losses and flow path losses for fluid flow 62 as compared to conventional shrouds. Moreover, straight portion 206 and angled portion 208 facilitate minimizing and/or eliminating re-circulation of leakage flow 62 into bucket outlet side 88, which minimizes and/or eliminates mixing of leakage flow 62 with main flow 64.

Figure 10:
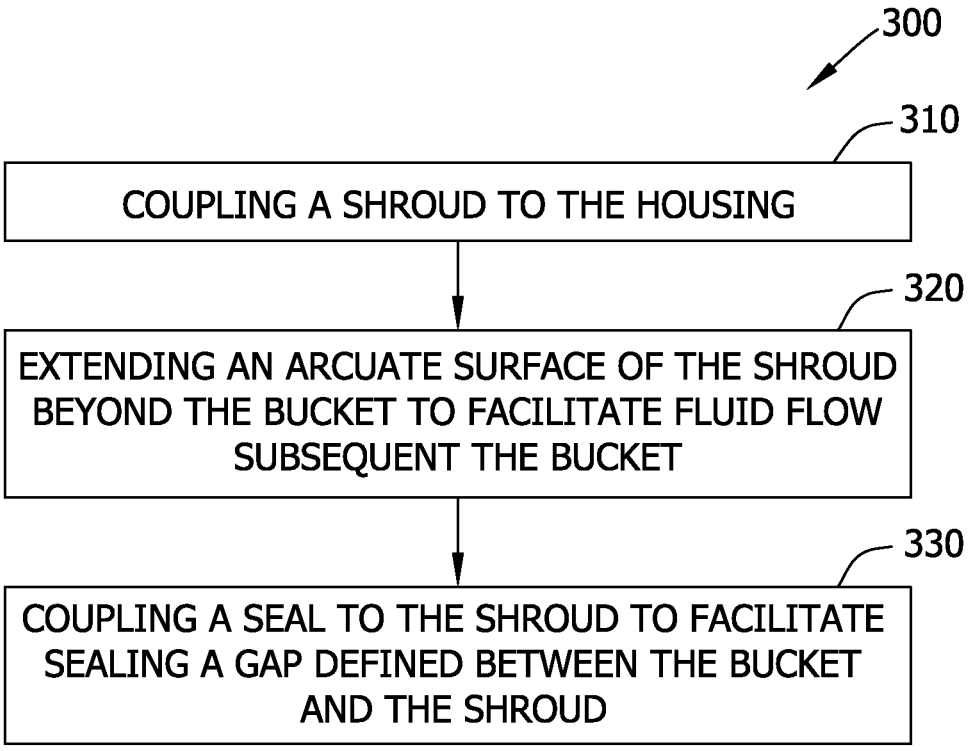
FIG. 10 is a flowchart of an exemplary method of assembling a turbine.

FIG. 10 is a flowchart illustrating an exemplary method 300 of assembling a turbine, for example turbine 32 (shown in FIG. 2). In the exemplary method 300, turbine includes a housing, a rotatable shaft, and a rotor coupled to shaft. The rotor includes a bucket that extends radially outward from the shaft. Method 300 includes coupling 310 a shroud, for example shroud 56 (shown in FIG. 4), to the housing. The shroud includes an alignment member having a first end, a second end, and a body extending between the first and second ends, such as alignment member 110, first end 112, second end 114, and body 116 (all shown in FIG. 4). The second end includes an arcuate portion, for example arcuate portion 128 (shown in FIG. 4). The body includes a first groove and a second groove, such as first groove 132 and second groove 134 (shown in FIG. 4).

Method 300 includes extending 320 the arcuate portion relative to and beyond the bucket to facilitate fluid flow downstream to a subsequent nozzle. In the exemplary embodiment, orientating the arcuate portion includes extending the arcuate portion radially outward from the housing. A seal, such as seal 60 (shown in FIG. 4), is coupled 330 to the shroud to facilitate sealing a gap defined between the bucket and the shroud. In the exemplary embodiment, the seal is coupled to the body between the first and second grooves.

During an exemplary operation of turbine 32, fluid flow 64 is channeled through nozzle 74 towards buckets 78, which causes buckets 78 to rotate with turbine shaft 46 to induce work output by shaft 46. A portion of leakage flow 62 is channeled from inlet side 86 of bucket 78 into gap 66. Bucket tip 92 (shown in FIG. 3) with teeth 94 and shroud seal 60 (shown in FIG. 4) facilitates mitigating leakage losses from leakage flow 62 such as, for example, hot gas flow through gap 66. Leakage flow 62 is leaked through labyrinth paths formed by bucket teeth 94, honeycomb seal 150, and seal tooth 156 (shown in FIG. 4). Fluid flow 62 is then channeled towards arcuate portion 128 of shroud 56. Arcuate portion 128 facilitates directing leakage flow 62 smoothly towards nozzle side wall 108 without any sharp turnings and reverse flow and/or re-circulated flow downstream from bucket 78. Each subsequent nozzle 102 directs fluid flow 64 downstream towards another bucket (not shown) for rotation.

The embodiments described herein enhance the efficiency, reliability, and reduced maintenance costs and outages of the associated turbine as compared to conventional shrouds. An arcuate portion of the shroud is sized and shaped to align and channel gas flow out of a clearance gap defined between the shroud and a rotor and towards a subsequent nozzle. The arcuate portion is sized and shaped to facilitate reducing flow leakages and losses of gas flow from the bucket.

Although the embodiments are herein described and illustrated in association with a turbine for a gas turbine, it should be understood that the present invention may be used for controlling any fluid between any generally high pressure area and any generally low pressure area within any rotary machine. Accordingly, practice of the exemplary embodiments is not limited to gas turbines.

Exemplary embodiments of systems and methods for using a shroud are described herein in detail. The systems and methods are not limited to the specific embodiments described herein, but rather, components of systems and/or steps of the method may be utilized independently and separately from other components and/or steps described herein. Each component and each assembly step may also be used in combination with other components and/or assembly steps. Although specific features of various embodiments may be shown in some drawings and not in others, this is for convenience only. Any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A shroud for use with a turbine including a housing, a rotatable shaft and a bucket extending outward from the rotatable shaft, said shroud comprising:

an alignment member coupled to the housing and comprising a first end, a second end, and a body extending between said first and said second ends, said second end comprises an arcuate portion configured to facilitate leakage flow downstream from the bucket, said second end further comprises one of the following:

(i) a pair of substantially straight portions, wherein said arcuate portion extends between said pair of substantially straight portions; and (ii) a substantially straight portion that extends between said first end and said arcuate portion; and a seal coupled to said body to facilitate sealing a gap defined between the bucket and said body.

2. The shroud of claim 1, wherein said arcuate portion extends radially outward from the housing.

3. The shroud of claim 1, wherein said second end comprises said pair of substantially straight portions, a first of said substantially straight portions is oriented obliquely relative to a second of said substantially straight portions.

4. The shroud of claim 1, wherein said body comprises a first groove and a second groove defined therein such that said first groove has a first length and said second groove has a second length that is longer than said first length.

5. The shroud of claim 4, wherein said second groove comprises a first angled side oriented at a first angle with respect to said body and a second angled side oriented at a second angle with respect to said body, said first angle is larger than said second angle.

6. The shroud of claim 1, wherein said second end is configured in fluid flow alignment with a nozzle of the turbine.

7. A turbine comprising:

a housing;

a turbine shaft rotatably supported in said housing; and a plurality of turbine stages located along said turbine shaft and contained within said housing, each turbine stage comprising:

a rotor coupled to said turbine shaft, said rotor comprising a bucket extending radially outward therefrom;

a shroud coupled to said housing and comprising a first end, a second end, and a body extending between said first and second ends, said second end comprises an arcuate portion configured to facilitate leakage flow downstream from said bucket towards a nozzle, said second end further comprises one of the following:

(i) a pair of substantially straight portions, wherein said arcuate portion extends between said pair of substantially straight portions; and (ii) a substantially straight portion that extends between said first end and said arcuate portion; and a seal coupled to said first groove and said second groove to facilitate sealing a gap defined between said bucket and said body.

8. The turbine of claim 7, wherein said second end comprises said pair of substantially straight portions, a first of said pair of substantially straight portions is angled less than about 45° to a second of said pair of substantially straight portions.

9. The turbine of claim 7, wherein said second end comprises said pair of substantially straight portions, at least one of said arcuate portion and said pair of substantially straight portions are in flow alignment with a nozzle wall of a subsequent stage of said plurality of stages to facilitate alignment of leakage flow toward said nozzle wall.

10. The turbine of claim 7, wherein said body comprises a first groove and a second groove, and wherein said seal comprises a seal tooth between said first groove and said second groove and extending radially into the gap.

11. The turbine of claim 10, wherein said bucket includes a first radial tooth and a second radial tooth, said first radial tooth is spaced from said seal tooth at a first distance and said second radial tooth is spaced from said second end a second distance, said first distance is longer than said second distance.

12. A method of assembling a turbine including a housing, a rotatable shaft, and a bucket extending radially outward from the rotatable shaft, said method comprising:

coupling a shroud to the housing, the shroud comprising an alignment member coupled to the housing and comprising a first end, a second end, and a body extending between the first and the second ends, the second end comprises an arcuate portion configured to facilitate leakage flow downstream from the bucket, wherein the second end further comprises one of the following:

(i) a pair of substantially straight portions, wherein said arcuate portion extends between said pair of substantially straight portions; and (ii) a substantially straight portion that extends between said first end and said arcuate portion;

extending the arcuate portion of the shroud outward from the housing to facilitate leakage flow downstream from the bucket; and coupling a seal to the shroud to facilitate sealing a gap defined between the bucket and the shroud.

13. The method of claim 12, wherein extending the arcuate portion comprises positioning the arcuate portion to extend radially from the housing.

14. The method of claim 12, wherein coupling the seal comprises coupling the seal to a first groove and a second groove of the shroud.

* * * * *